US005636663A

United States Patent [19]

Lacroix

[11] Patent Number: 5,636,663

[45] Date of Patent: Jun. 10, 1997

[54] HARNESS SYSTEMS FOR WEAVING LOOMS INCLUDING DISCONNECTABLE NECK AND HARNESS CORDS

[75] Inventor: Jean-Jacques Lacroix, Poisy, France

[73] Assignee: S.A. des Etablissements Staubli, Faverges, France

[21] Appl. No.: 546,718

[22] Filed: Oct. 23, 1995

[30] Foreign Application Priority Data

Oct. 25, 1994 [FR] France ..... 94 13040

[51] Int. Cl.[6] ..... D03C 3/40

[52] U.S. Cl. ..... 139/86; 139/59; 139/88; 24/616; 403/329

[58] Field of Search ..... 139/85, 86, 87, 139/59; 24/616; 403/329

[56] References Cited

U.S. PATENT DOCUMENTS 3,724,512 4/1973 Kohl ..... 139/85

5,309,950 5/1994 Bassi et al. ..... 139/85

FOREIGN PATENT DOCUMENTS 43 06 978 9/1994 Germany ..... 139/85

*Primary Examiner*—Andy Falik

*Attorney, Agent, or Firm*—Dowell & Dowell

[57] ABSTRACT

A harness system for weaving looms wherein neck cords connected to an actuating mechanism for controlling the movement of at least one heddle are releasably connected to harness cords connected to the at least one heddle by way of collars having releasably engageable male and female portions. The harness cords pass through openings in a control member which is reciprocally moveable so as to move the collars relative to guides through which the neck cords extend from the actuating mechanism.

10 Claims, 10 Drawing Sheets

HARNESS SYSTEMS FOR WEAVING LOOMS INCLUDING DISCONNECTABLE NECK AND HARNESS CORDS

BACKGROUND OF THE INVENTION

The present invention relates to jacquard systems for forming the shed in weaving machines and more particularly to the harnesses which are coupled to the mobile members for actuating these systems for controlling the warp yarns.

HISTORY OF THE RELATED ART

In its conventional construction, a harness system is known to comprise a plurality of threads, in a number equal to that of the members actuating the system, each of these threads being connected to one or more harness cords which are connected to one or more eyebearing heddles. The threads and cords are connected with the aid of snaps and it will be readily appreciated that the dismantling of a harness system for repairing or replacing it and subsequently re-assembling it, involves the manual maneuvering of several thousands of snaps. The operation is consequently long and fastidious.

It is an object of the present invention to overcome these drawbacks by producing a harness which is arranged so that the manual or mechanized maneuvering of one member causes connection or disconnection of the whole of the harness and the members actuating the system.

SUMMARY OF THE INVENTION

To that end, the harness system according to the invention is principally noteworthy in that it comprises a control member which is perforated for the passage of the harness cords and which is associated with an actuation mechanism adapted to impart thereto a reciprocating movement oriented parallel to the axis of the cords. Collars formed by male and female elements are adapted to fit axially to ensure connection of the cords. Neck cords are coupled to the member for actuating the system and are arranged in combination with thread guides traversed axially by the neck cords, to be locked and unlocked under the effect of the reciprocating movements of the moveable control member.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
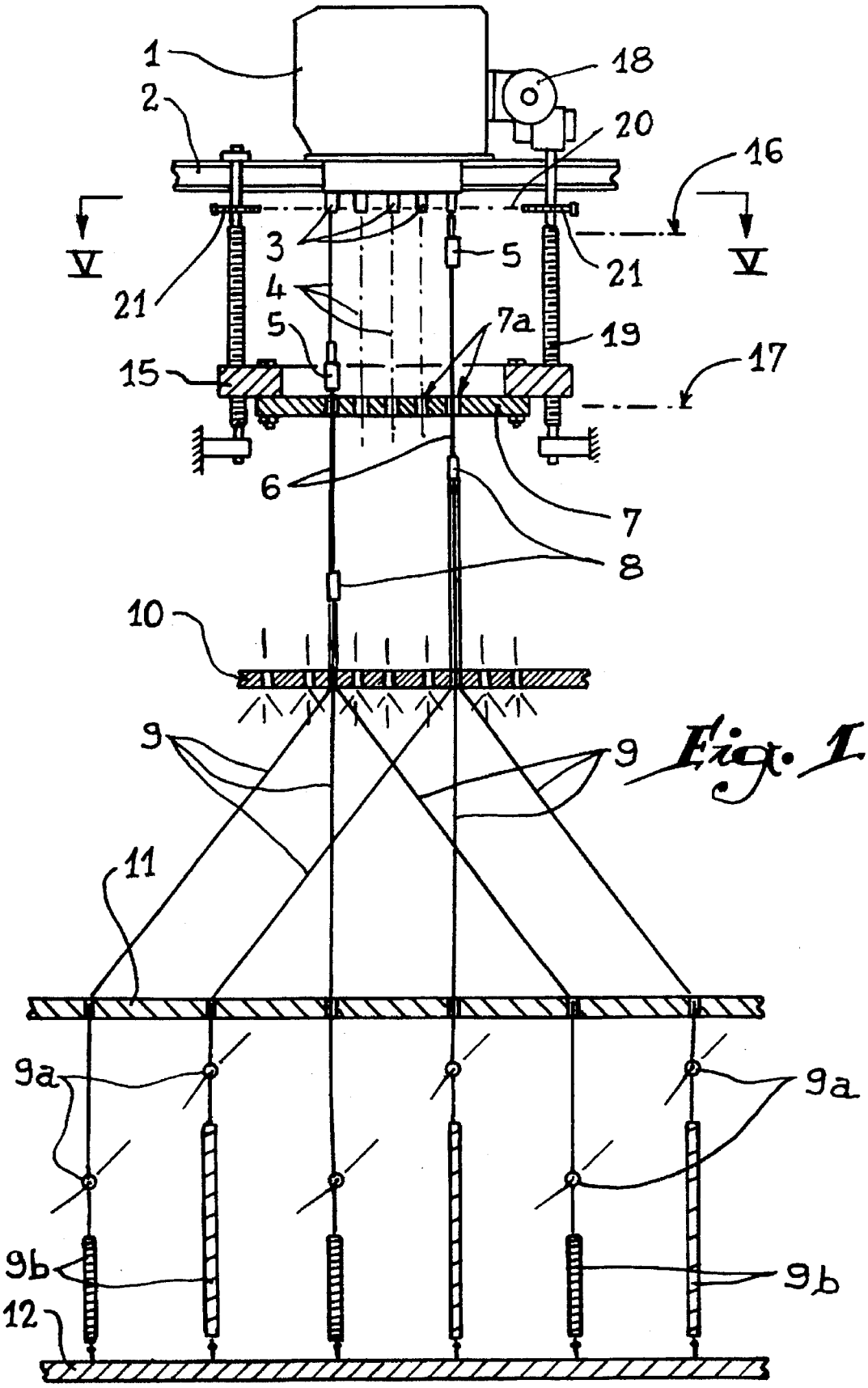
FIG. 1 is a view in elevation schematically showing a weave system equipped with a harness system according to the invention.

Referring now to the drawings, and firstly to FIG. 1, reference 1 designates a weave actuation system of the VERDOL or JACQUARD type, supported above the weaving machine by a structure 2. The lower part of the system 1 is provided with a series of neck cord guides 3, in a number equal to that of the neck cords 4 of the system. Each cord 4 traverses the corresponding guide 3 axially, to be assembled, by means of a connectable collar 5, on a harness cord 6 which traverses a control board 7 which is connected, by means of a clip such as 8, to one or more heddles 9. These latter are guided by a fixed perforated board 10 below which each of them traverses a tie board 11 and supports a thread-guiding eye 9*a* before being attached to a return spring 9*b* hooked to a bottom board 12 placed beneath the weaving machine (not shown).

The harness system according to the invention is composed of the elements or members referenced from 3 to 12.

Each collar 5 comprises two parts, namely a female element 13 (FIG. 2) secured to the corresponding harness cord 6, and a male piece 14 whose lower part cooperates with the element 13, while its upper part is adapted to be fitted in one of the guides 3.

Figure 3:
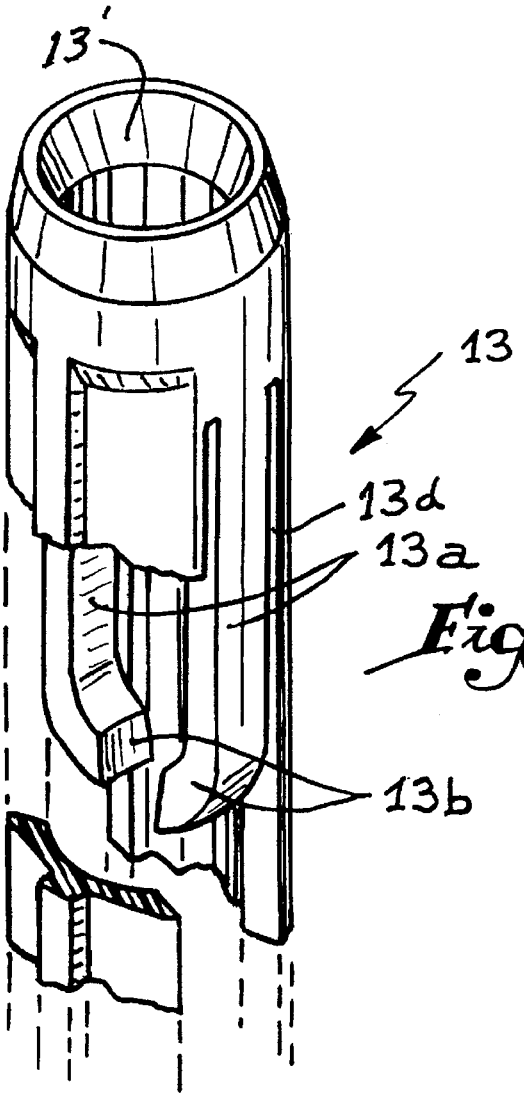
FIG. 3 illustrates the arrangement of the female element of the collar according to FIG. 2.

As shown more particularly in FIG. 3, the female element 13 is an upwardly open, tubular cylindrical part, obtained by moulding a semi-rigid synthetic material capable of deforming elastically. Beneath its upper opening 13', part 13 is cut out longitudinally with slots 13*d* which define two opposite jaw elements 13*a* independent of each other, whose lower ends are curved to form a grip or clamp 13*b* of slightly concave profile.

Figure 2:
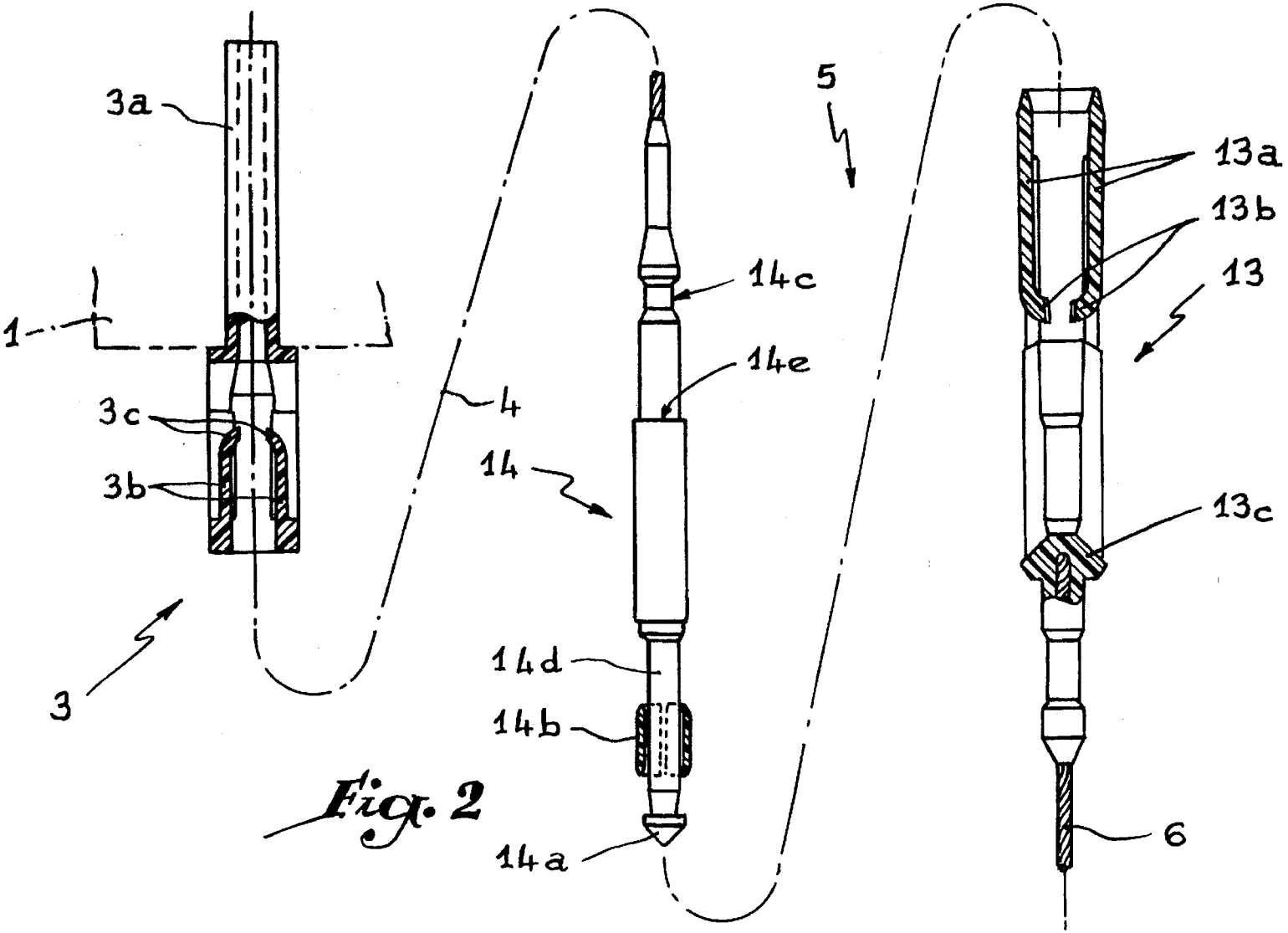
FIG. 2 shows in partial axial section the two elements constituting one of the assembly collars of the harness, as well as the retaining neck cord guide which is associated therewith.

The male element 14 is a cylindrical part made of rigid plastic material whose lower end has a larger diameter to form a harpoon tip 14*a* (FIG. 2). On the cylindrical part of smaller diameter which surmounts this projecting tip 14*a*, there freely slides a split ring or shuttle 14*b*. The upper part of element 14 decreases in diameter and has an annular recess 14*c* therein; this upper part is provided to be axially hollow in order to receive and retain the end of one of the neck cords 4 of the system, in the same way as the base of the female part 13 of the collar is arranged to receive and retain the end of a harness cord 6.

Figure 4:
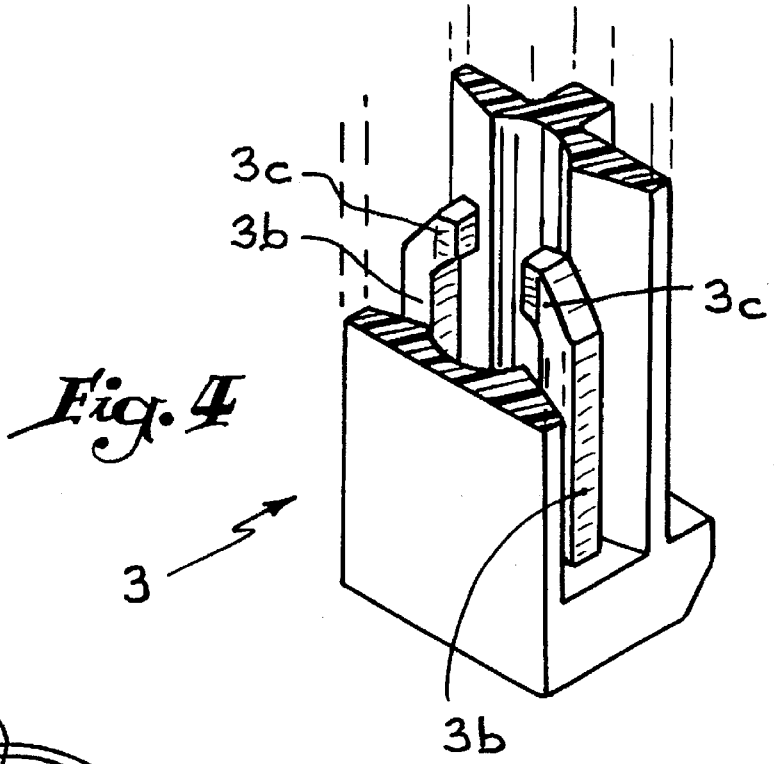
FIG. 4 similarly illustrates the arrangement of the neck cord guide.

Each guide 3 is constituted by a tubular piece made of elastically deformable synthetic material which, below an upper shank 3*a* adapted to be fixed, for example by elastic or frictional fitting, in one of the conventional lower openings made in the floor of the system 1 for the passage of the cords 4, is split longitudinally in order to define two opposite jaw elements 3*b* facing upwardly. The free upper end of each of these jaw elements 3*b* is shaped to constitute a terminal grip or clamp 3*c* adapted to cooperate with the annular recess 14*c* of the male element 14, as will be described hereinafter. FIG. 4 clearly shows the arrangement of the clamp formed by the two jaw elements 3*b*, which clamp is axially traversed by one of the cords 4 of the system 1.

Figure 5:
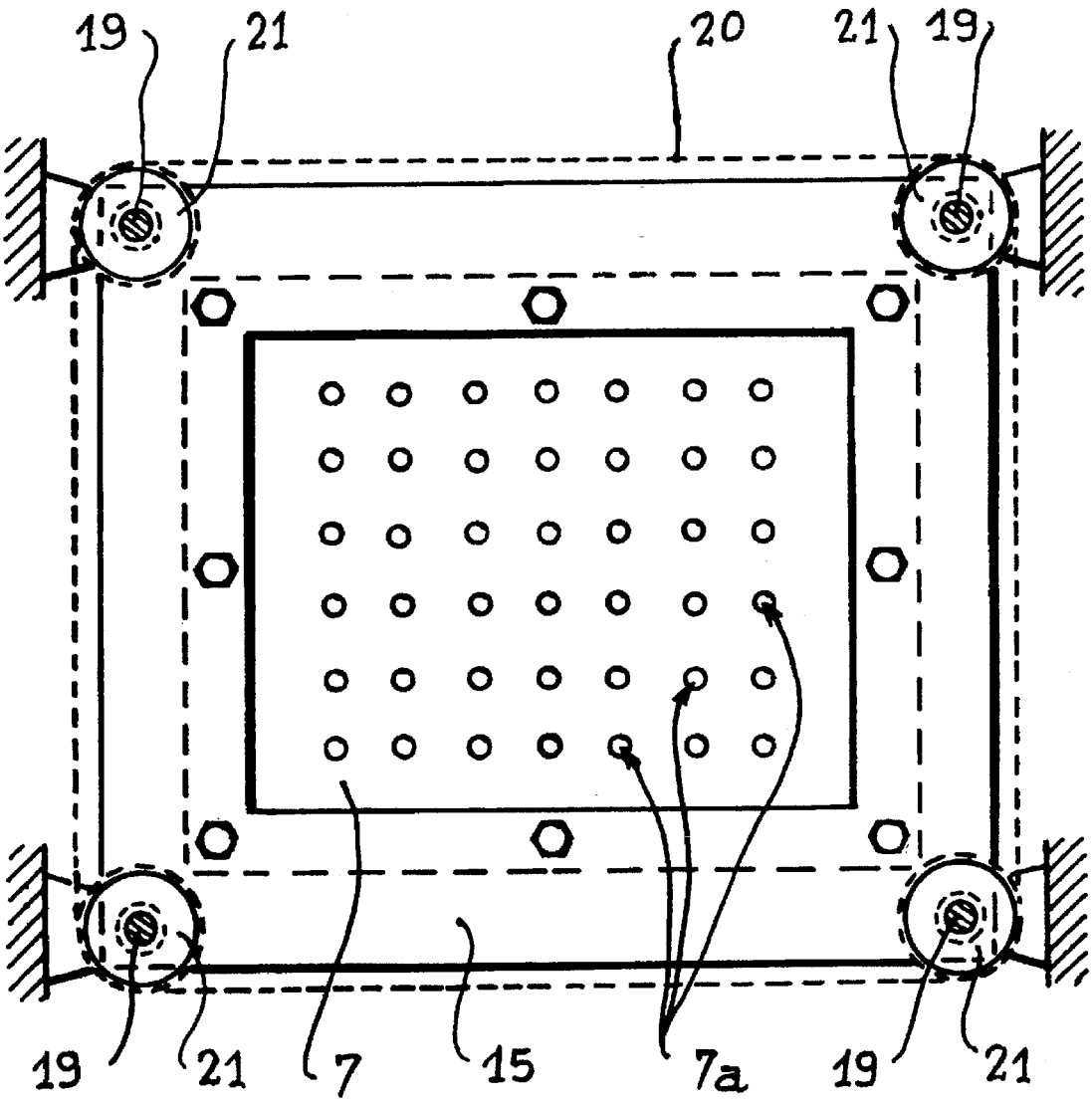
FIG. 5 is a schematic horizontal section of the harness system on a larger scale, along plane V—V in FIG. 1.

The clips 8 which ensure connection between the cords 6 and the heddles 9 are of the conventional type and will therefore not be described in detail. Each of the cords 6 is freely engaged through an opening 7*a* made in the control board 7, as illustrated in FIGS. 1 and 5. It will be noted that the openings 7*a* have an inner diameter slightly smaller than the outer diameter of the clips 8, as will be more readily understood hereinafter.

Board 7, which forms an integral part of the harness system according to the invention, is removably mounted to a moveable frame associated with a raising and lowering mechanism intended to ensure its reciprocating vertical displacement between the two levels indicated at 16 and 17 in FIG. 1.

In the embodiment illustrated in FIGS. 1 and 5, this raising and lowering mechanism comprises a small gear motor 18 which is fixed to the system 1 to effect rotation, in one direction or the other, of one of four threaded rods 19 oriented vertically and connected to one another by a chain 20 stretched between four toothed wheels 21 fitted on the rods 19. Each of these latter cooperates with a corresponding nut embedded in the frame 15 in the vicinity of each corner thereof, so that the gear motor 18 ensures vertical displacement of the control board 7.

It goes without saying that the raising and lowering mechanism described hereinbefore may be actuated manually with the aid of a crank in place of the gear motor 18, or may be replaced by a system of hydraulic double-action jacks.

Figure 6:
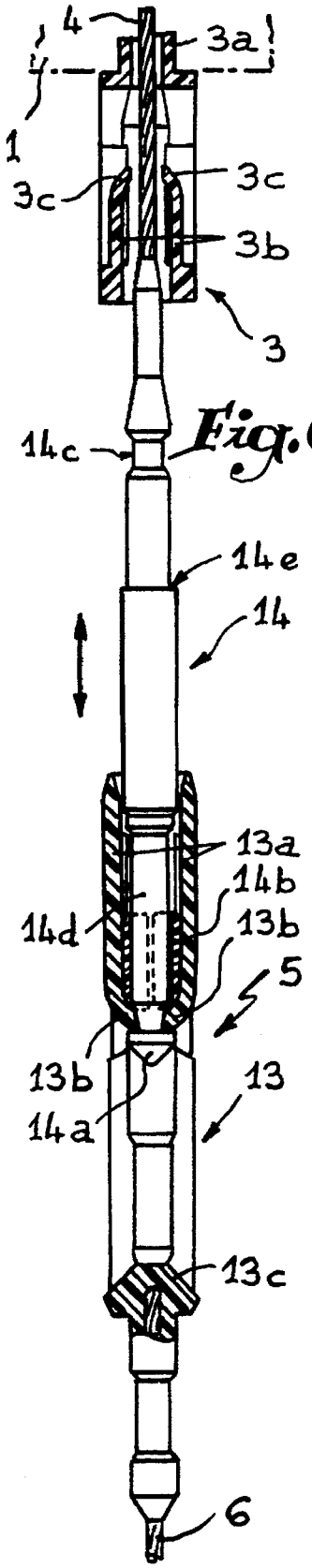
FIGS. 6 to 11 are axial sections illustrating the successive phases of the process of dismantling and re-assembly of the harness system, FIGS. 6A, 7A, 8A, 8B, 9A, 9B, 9C and 10A showing, on a larger scale, the position of the parts of the collars at these phases.
Figure 6A:
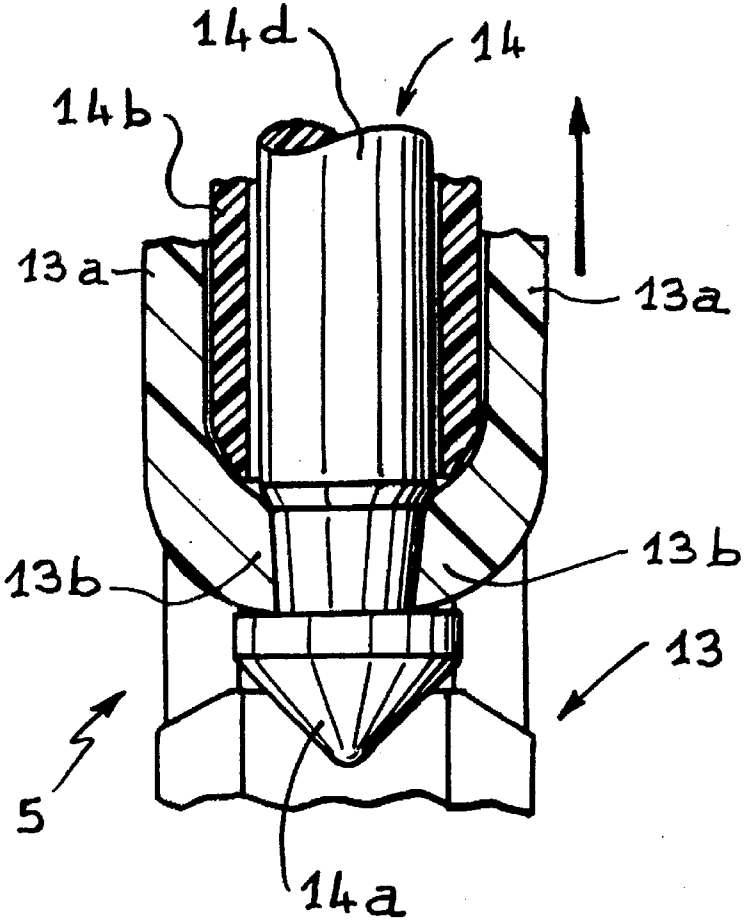

When the system 1 is in operational state, each of the neck cords of the harness system according to the invention is in the position illustrated in FIG. 6. The projecting tip 14*a* is engaged in the female element 13 and lies in an axial position such that the lower grips 13*b* are disposed immediately above the tip (FIG. 6A) which is thus retained in place. The control board 7 is then located at the lower level 17 of its stroke such that each collar 5 is free to move vertically in reciprocating manner, without being hindered by a guide 3 nor by the board 7, while each neck cord 4 is solidly fastened to its harness cord 6.

Figure 7:
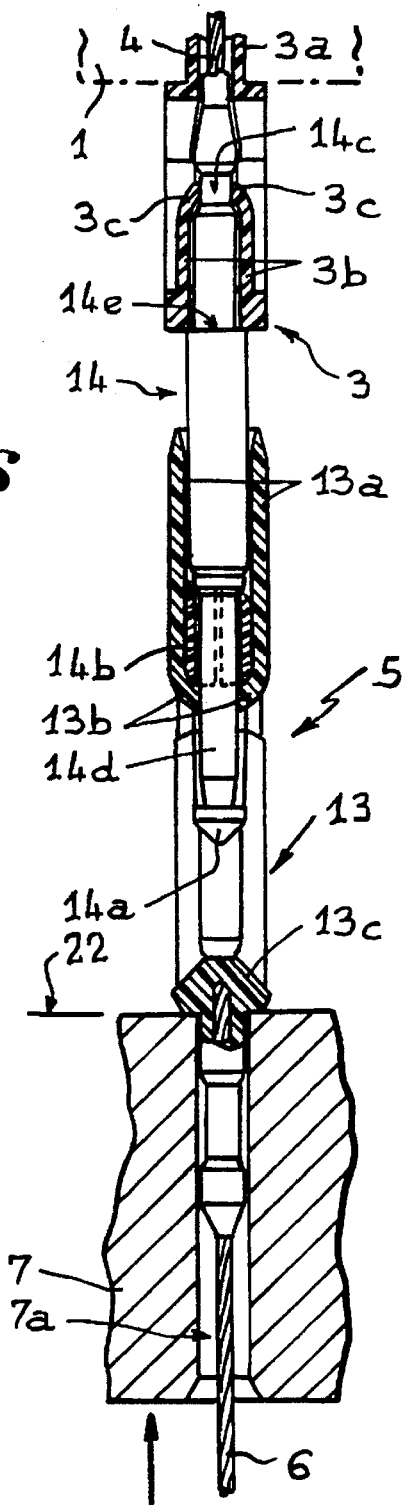
Figure 7A:
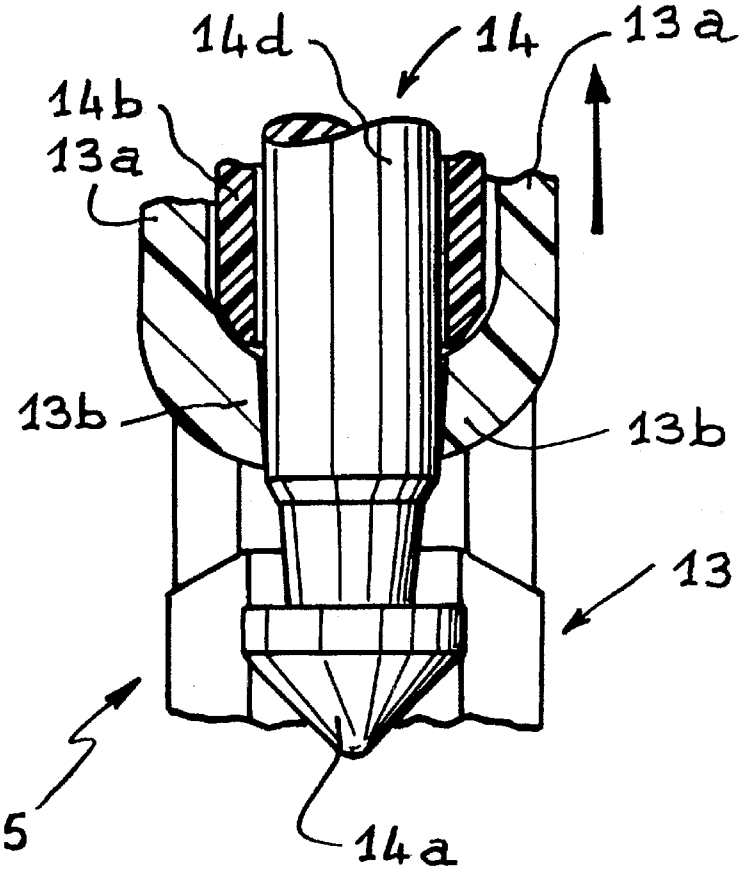

When it is desired to dismantle the harness system, the operator actuates the raising and lowering mechanism displacing the frame 15 and the board 7 upwardly. In this ascending movement, the upper face of board 7 successively abuts against an annular shoulder 13*c* provided in the lower part of each of the female elements 13, and axially pushes all the collars 5 upwardly. This ascending movement continuing, the grips 13*b* of the jaw elements 13*a* slide along the cylindrical part 14*d* (FIG. 7A) which surmounts the end 14*a*, causing the ring or shuttle 14*b* to rise. Simultaneously, the upper end of piece 14 is engaged inside the guide 3 until the grips 3*c* thereof clip in the annular recess 14*c* and an annular shoulder 14*e* strikes the lower edge of this guide 3 (cf. FIG. 7).

All the collars 5 then lie at the same height, corresponding to the level of the board 7 which has been referenced 22 and which is the locking level.

Figure 8:
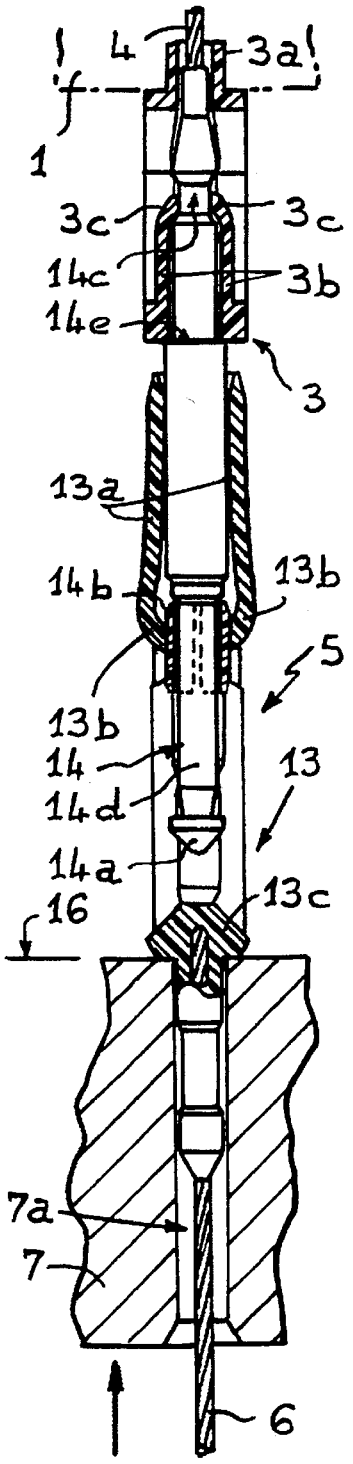
Figure 8B:
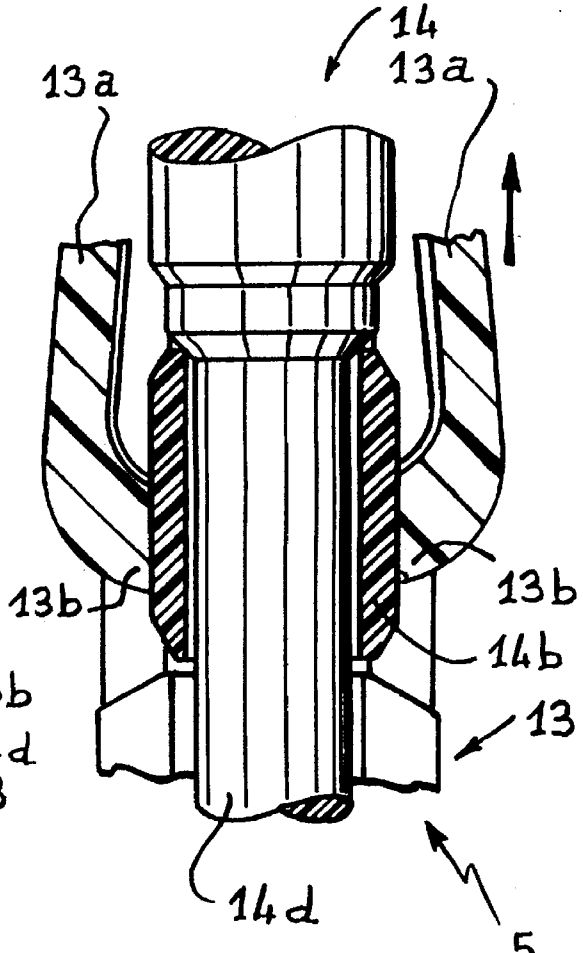
Figure 8A:
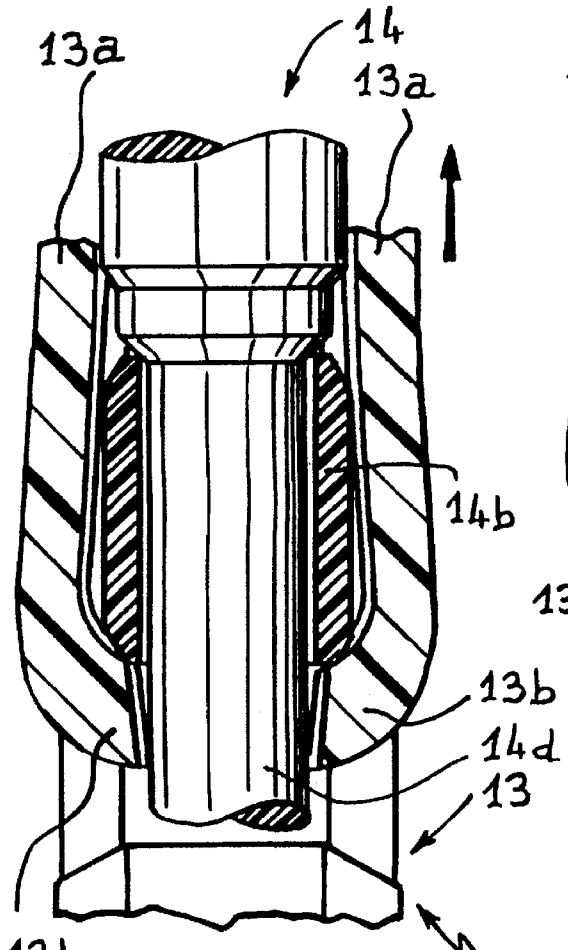

Frame 15 and board 7 continue their upward displacement until level 16 of their stroke is reached. In this movement, piece 14 cannot move upwardly due to the contact of shoulder 14*e* against the guide 3. Under these conditions, only the female element 13 of collars 5 moves upwardly (FIG. 8); as the shuttle 14*b* has arrived at the end of top stroke (FIG. 8A), grips 13*b*, after their opening has been controlled by the bevelled lower edge of the shuttle, grip the latter which is then firmly connected axially, as shown in FIG. 8B.

Figure 9A:
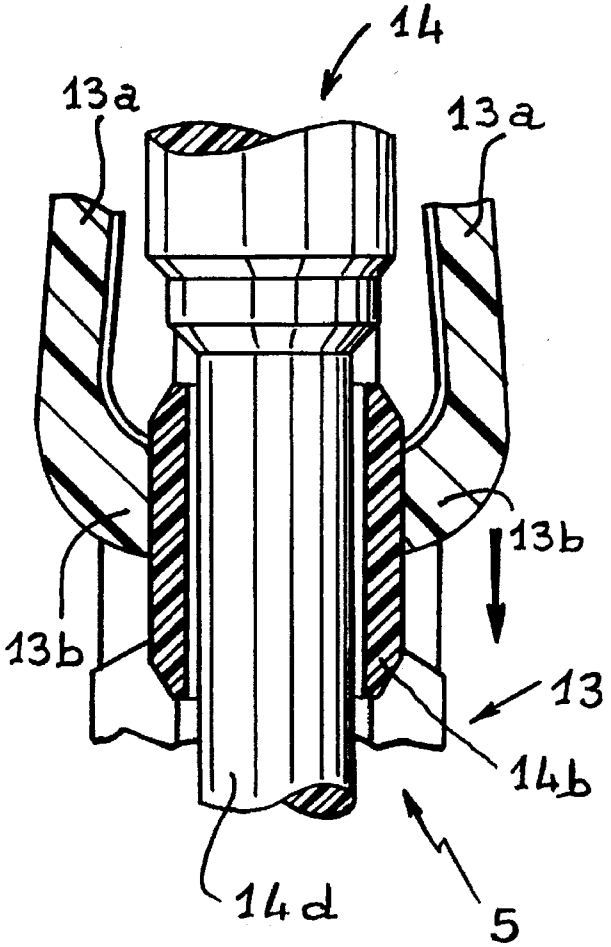
Figure 9:
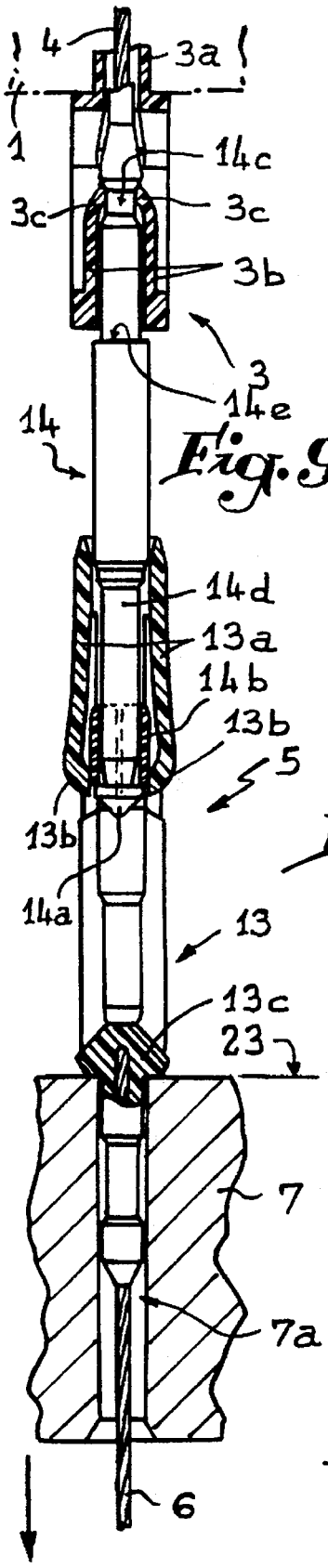
Figure 9C:
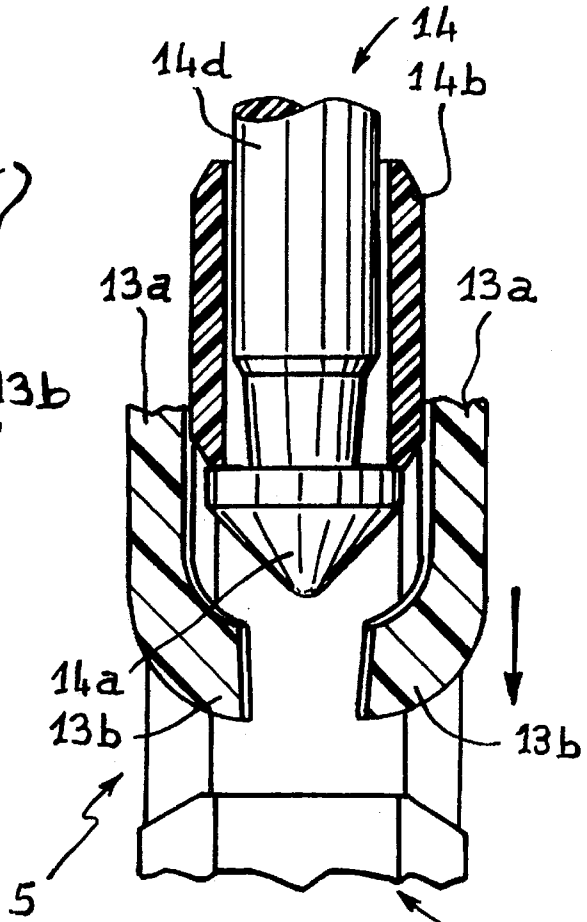
Figure 9B:
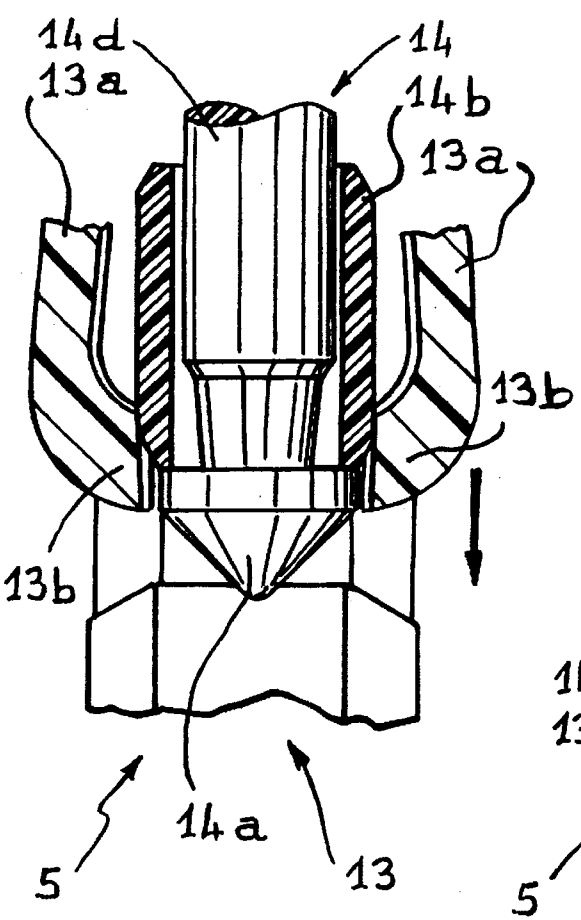

The direction of rotation of the gear motor 18 is then reversed, which has for its effect to lower board 7. The return springs 9*b* associated with the heddles 9 cause the elements 13 to move downwardly following the lowering of board 7 (cf. FIG. 9), with the result that the shuttles 14*b*, still clamped by the grips 13*b*, follow the downward displacement (FIG. 9A). At a given point of the descending movement, the shuttle 14*b* is immobilized against the upper face of the end 14*a* (FIG. 9B), which enables the grips 13*b* to escape the hooking on the large-diameter part of the end 14*a* due to the fact that the height of the grips is greater than the height of the lower bevel of the shuttle and move closer to each other in the manner illustrated in FIG. 9C.

Figure 10:
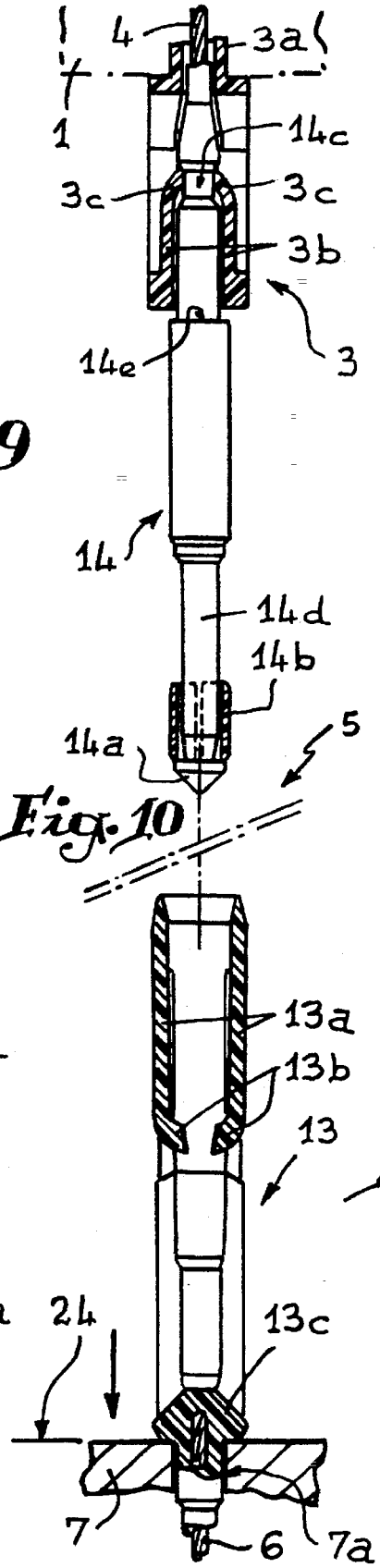

As pieces 14 remain locked in the upper position by the clamps of the guide 3, the fact of the downward displacement of the board 7 and the female elements 13 continuing to level 24, causes separation of elements 13 and 14, in the manner illustrated in FIG. 10.

At level 24, the tension of springs 9*b* is virtually cancelled, so that board 7 may then be disconnected from the moveable frame 15 and the assembly of the harness, except for the guides 3 and the pieces 14 immobilized in the upper position, is in a dismantled position and may be removed.

Figure 11:
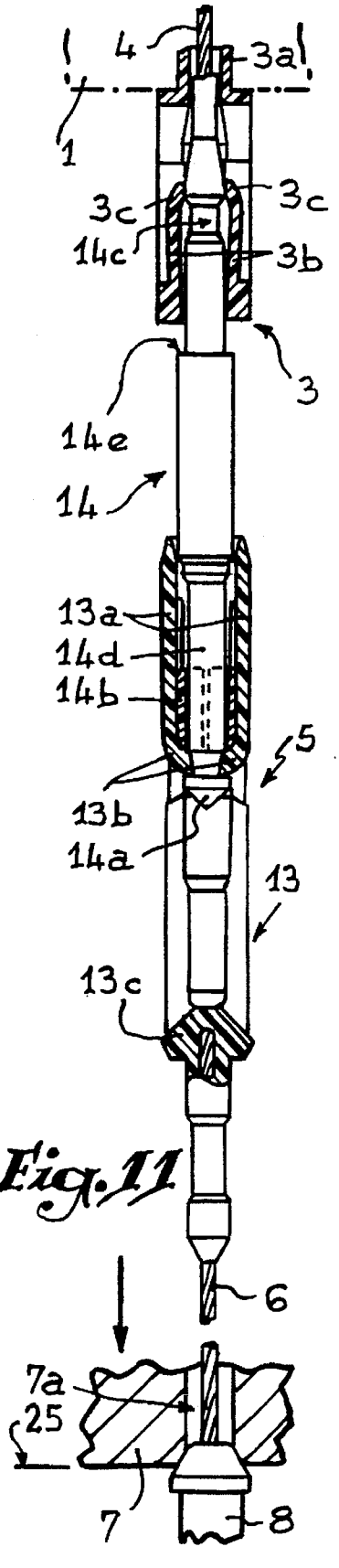
Figure 10A:
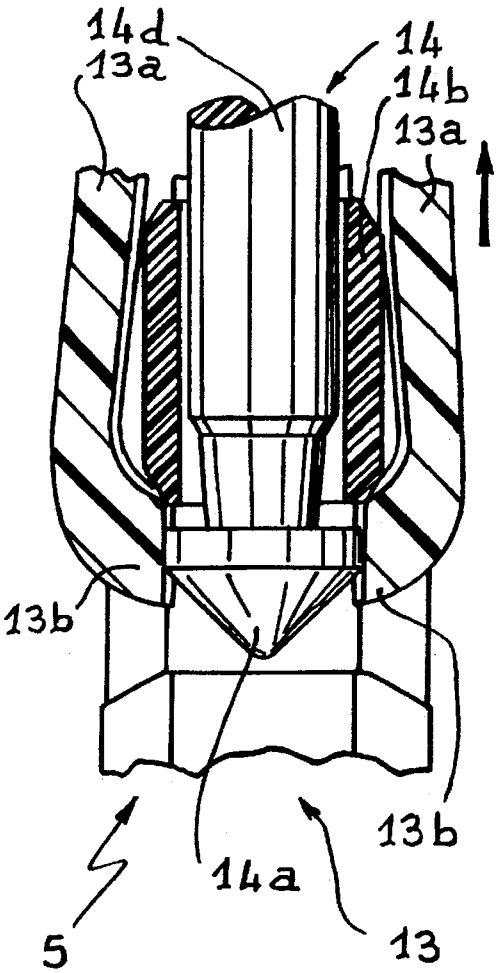

It will be understood that this harness system may be reassembled by imparting to board 7, from level 24, an ascending stroke followed by a descending stroke, it being observed that the ascending stroke does not exceed the level of hooking 22, the phases of the process taking place in the direction opposite that which has just been set forth for dismantling; FIG. 10A illustrates the spaced apart relationship of grips 13*b* at the end 14*a* and the rise of shuttle 14*b*, said grips then being locked above end 14*a* (FIG. 6A), in the position of FIG. 6. Once the two elements constituting the different collars 5 of the harness are locked on each other, it suffices to continue the descending movement of control board 7 to the minimum level 25 of FIG. 11. As shown, the lower face of board 7 abuts against clips 8, creating on cords 6 and pieces 14 a force which obliges jaws 3*b* of the thread guides 3 to open, releasing the pieces. By a very slight rise of board 7 up to level 17, the normal operational position according to FIGS. 1 and 6 is consequently resumed.

The invention therefore provides a harness system whose assembly and dismantling operations require only the maneuver of one raising and lowering mechanism, thus avoiding the fastidious manipulation of a plurality of coupling snaps or clips. It goes without saying that the different strokes of board 7 between the levels indicated above are determined by position detectors of conventional type.

It will be readily appreciated that the clamps contained in the guides 3 and the female elements 13 of the collars 5 may comprise more than two jaw elements. In addition, it will be understood that the arrangement of the elements 13 and 14 of the collars 5 may be reversed, by a suitable orientation of the jaw elements 13*a*.

It will further be noted that the harness cords 6 may advantageously be constituted, not by supple members identical to the cords 4, but by rigid rods adapted to ensure stabilization of lateral vibrations.

Figure 12:
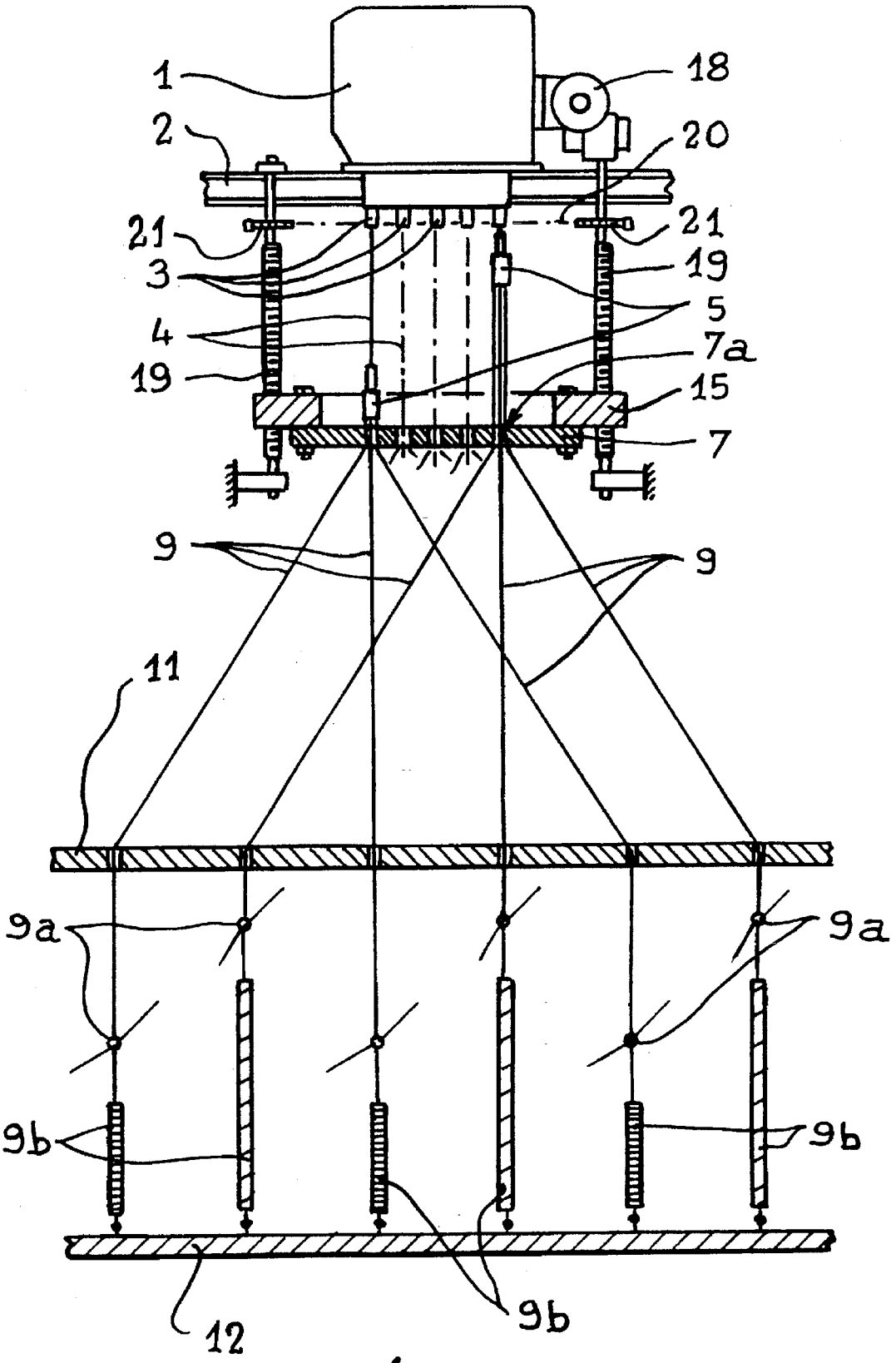
FIG. 12 is a view similar to FIG. 1, illustrating a varied embodiment of the invention.

FIG. 12 illustrates a variant embodiment of the invention in which the fixed perforated board 10 according to FIG. 1 is eliminated, its role of guiding being performed by the perforated control member 7. However, this embodiment, which is obviously simpler, can suit only in the case of the return springs 9*b* associated with the heddles 9 exerting a sufficient axial effort to effect extraction of the collars 5 from the guides 3 at the end of the coupling operation, without intervention of the clips 8 of the embodiment described hereinabove.

What is claimed is:

1. A harness system for a weaving loom wherein a plurality of neck cords are connected at one end to an actuation system for controlling the reciprocating movement of a plurality of harness cords which are connected to at least one heddle, the harness system comprising, a moveable control member having a plurality of openings therethrough through which the harness cords extend, an actuation mechanism connected to said moveable control member for moving said control member reciprocally and generally parallel with respect to the harness cords, a plurality of guides through which the neck cords extend, a plurality of collar means oriented between said plurality of guides and said moveable control member for releasably connecting each of the neck cords with an aligned harness cord, each of said collar means including male and female elements which are adapted to be releasably connected to one another under the effect of the reciprocating movement of said moveable control member.

2. The harness system of claim 1 in which said actuation mechanism includes a plurality of threaded rods, drive means connected to said rods for simultaneously rotating said rods, said rods being threadingly engaged to a frame whereby said frame is moved in a reciprocating manner dependent upon the direction of rotation of said rods, and said moveable control member being supported by said frame.

3. The harness system of claim 1 wherein each of said female elements includes jaw elements having gripping portions profiled to clamp an aligned male element spaced inwardly of a tip portion thereof.

4. The harness system of claim 3 in which a moveable shuttle is mounted to each of said male elements so as to be moveable relative to an elongated axis of said male elements, said shuttles being engageable by said gripping portions of said female elements to thereby open said gripping portions as said male and female elements are moved toward one another by movement of said moveable control member toward said guides and thereafter retain said gripping portions open to permit said gripping portions to pass beyond said tip portions of said male elements to separate said male and female elements to thereby release the harness cords from the neck cords.

5. The harness system of claim 4 wherein said female elements are connected to said harness cords and said male elements are connected to another end of the neck cords.

6. The harness system of claim 5 wherein each of said guides includes jaw elements having gripping portions adapted to engage in a depression of an aligned male element to thereby retain said male elements connected thereto as said female elements are released from engagement with said male elements.

7. The harness system of claim 6 in which said actuation mechanism includes a plurality of threaded rods, drive means connected to said rods for simultaneously rotating said rods, said rods being threadingly engaged to a frame whereby said frame is moved in a reciprocating manner dependent upon the direction of rotation of said rods, and said moveable control member being supported by said frame.

8. The harness system of claim 1 wherein the harness cords extending between said collar means and said at least one heddle are rigid rods.

9. The harness system of claim 1 wherein said control member is a perforated board.

10. A harness system for a weaving loom wherein a plurality of neck cords are connected at one end to an actuation system for controlling the reciprocating movement of a plurality of harness cords which are connected to at least one heddle, the harness system comprising, a moveable control member having a plurality of openings therethrough through which the harness cords extend, an actuation mechanism connected to said moveable control member for moving said control member reciprocally and generally parallel with respect to the harness cords, a plurality of guides through which the neck cords extend, a plurality of collar means oriented between said plurality of guides and said moveable control member for releasably connecting each of the neck cords with an aligned harness cord, each of said collar means including male and female elements which are adapted to be releasably connected to one another under the effect of the reciprocating movement of said moveable control member, each of said guides having gripping portions for engaging said collar means as said collar means are urged toward said guides by said moveable control member, said female element including gripping portions for engaging said male elements to normally retain said female and male elements in joined relationship to thereby connect the neck cords to the harness cords, and shuttle means carried by said male elements adapted to engage said gripping portions of said female elements so that said female elements are separable from said male elements.

* * * * *